US010160626B2

(12) United States Patent
Dagn

(10) Patent No.: US 10,160,626 B2
(45) Date of Patent: Dec. 25, 2018

(54) LIFTING DEVICE FOR AUTOMOBILES

(71) Applicant: Rainer Dagn, Kossen (AT)

(72) Inventor: Rainer Dagn, Kossen (AT)

( * ) Notice: Subject to any disclaimer, the term of this patent is extended or adjusted under 35 U.S.C. 154(b) by 0 days.

(21) Appl. No.: 14/964,782

(22) Filed: Dec. 10, 2015

(65) Prior Publication Data

US 2016/0167936 A1 Jun. 16, 2016

(30) Foreign Application Priority Data

Dec. 10, 2014 (DE) ..... 20 2014 105 960 U

(51) Int. Cl.

| | |
|---|---|
| ***B66F 7/22*** | (2006.01) |
| ***B66F 7/00*** | (2006.01) |
| *B66F 3/24* | (2006.01) |

(52) U.S. Cl.

CPC ..... *B66F 7/22* (2013.01); *B66F 7/00* (2013.01); *B66F 3/24* (2013.01)

(58) Field of Classification Search

CPC ..... B66F 3/24; B66F 7/22; B66F 7/00; B66F 7/28

USPC ..... 414/678, 778, 782, 766, 777; 254/45, 254/93 R, 89 R, 93 VA, 90; 269/31

See application file for complete search history.

(56) References Cited

U.S. PATENT DOCUMENTS

| | | | | | |
|---|---|---|---|---|---|
| 1,286,504 | A | * | 12/1918 | Beckman | B23Q 1/5437 414/782 |
| 2,792,139 | A | * | 5/1957 | Lloyd | B60B 29/002 414/740 |
| 3,836,014 | A | * | 9/1974 | Johansson | B66F 7/0633 414/652 |
| 4,475,462 | A | * | 10/1984 | Tsumaki | B62D 65/18 198/680 |
| 5,046,912 | A | * | 9/1991 | Bostrom | B65G 67/54 414/358 |
| 5,833,030 | A | * | 11/1998 | Klockner | B62D 67/00 414/678 |

FOREIGN PATENT DOCUMENTS

| | | | |
|---|---|---|---|
| DE | 1070 358 | | 12/1959 |
| DE | 44 36 715 | A1 | 4/1996 |
| EP | 0417056 | A2 | 3/1991 |
| EP | 0 442 274 | A1 | 8/1991 |
| EP | 0624 543 | A2 | 11/1994 |
| FR | 14760971 | A | 4/1967 |
| JP | 2005067525 | A | 3/2005 |
| KR | 1020080078094 | A | 8/2008 |

* cited by examiner

*Primary Examiner* — James R Bidwell
(74) *Attorney, Agent, or Firm* — Horst M. Kasper, Esq.

(57) ABSTRACT

Lifting device for an automobile having hydraulic pistons for lifting and lowering which are guided in hydraulic cylinders positioned in a shaft which is positioned underground. A support which can be furnished by a plate is fixed at a free end of the hydraulic pistons. A receiver is hingedly mounted on the support and the receiver can be swiveled about a swivel axis which extends perpendicular to a plane and essentially horizontal in practice. A bearing having the pivot axis is fixedly mounted on the support.

10 Claims, 7 Drawing Sheets

LIFTING DEVICE FOR AUTOMOBILES

The invention relates to a lifting device for automobiles which can be realized as an in-ground lifting device or as an above-ground lifting device.

When an automobile is to be scrapped, the automobile is first drained and then dismantled. For this purpose, the automobile is first lifted so that all the liquids such as oils, brake fluid and fuels can be drawn off at the underside of the automobile. For subsequent dismantling, the automobile is placed on a second work ramp, which can be swiveled by 90° along the automobile longitudinal axis.

According to the invention, a lifting device is proposed on which the automobile can be lifted and tilted along its longitudinal axis in any lifting position. As a result, the automobile can be swiveled at every elevation, and so all the draining and dismantling operations can be performed in the most convenient working position in each case, and it is no longer necessary to move the automobile onto a second work ramp. Therefore, it is also possible to carry out the operations necessary for draining and dismantling in a short time.

The invention is exemplarily explained in more detail with reference to the drawing, in which FIG. 1 shows a side view of an in-ground lifting device having a tilting means in a partly lifted position, FIGS. 2*a* and 2*b* show different tilting positions of the lifting device according to FIG. 1, FIGS. 3 and 3*a* show an above-ground lifting device having a tilting means, FIG. 4 shows a tilting position of the above-ground lifting device, FIG. 5 shows another tilting position of the above-ground lifting device in lifted position, FIGS. 6 and 6*a* show enlarged views of the guide connection at the above-ground lifting device, FIG. 7 shows a side view of the above-ground lifting device having the tilting means in a partly lifted position similar to FIG. 1, and FIG. 8 is a plan view showing the above-ground lifting device of FIG. 7.

FIG. 1 shows an in-ground lifting device having hydraulic pistons 1 for lifting and lowering which are guided in hydraulic cylinders positioned in a shaft 1*a* which is positioned underground, as shown by line G of the ground. A support means 2 which can be embodied, for example, as a plate, is fixed at the free end of the two hydraulic pistons 1, which are positioned beneath each other in line with a bar 3.1.

A receiving means 3 is hingedly mounted on this support means 2 and the receiving means 3 can be swiveled about a pivot axis 4 which extends perpendicular to the plane of the drawing and essentially horizontal in practice. A bearing having the pivot axis 4 is fixedly mounted on the support means 2.

The receiving means 3 for receiving an automobile (see FIG. 3*a*) has a center bar 3.1 having laterally extending struts 3.11 on both ends, similar to the embodiment shown in FIG. 8. Plates 3.1*a* and 3.1*b* are provided on the free ends of the struts 3.11. Alternatively, wheel receiving blocks, for receiving the automobile wheels, can be provided. A vertically extending bar 3.2 is provided at the inner end of the horizontal center bar 3.1. An adjustable clamping arm 3.3 is mounted at the upper end of the vertical bar 3.2, and a top support plate 3.4 is hingedly joined to the free end of this clamping arm 3.3 and comes to abut on the roof of the automobile, so that the lifted automobile is fixed on the lifting device by means of the receiving means 3 as schematically shown in FIG. 3*a*.

In the embodiment shown, the clamping arm 3.3 is bent and is pivotable relative to the vertical bar 3.2 by means of a hydraulic cylinder 5. The clamping arm 3.3 can also be movable along the vertical bar 3.2 by means of a hydraulic or pneumatic cylinder (not shown).

The pivot axis 4 is preferably positioned at the lower end of the vertical bar 3.2 in the area of one of the lifting pistons 1. The pivot axis 4 can also be disposed in the middle area of the support means 2, that is, approximately symmetrically to the force applied by means of the two lifting pistons 1.

A hydraulic cylinder 6 is hingedly mounted on the support means 2 at a distance from the pivot axis 4, and this hydraulic cylinder 6 applies a force in the upper portion of the vertical bar 3.2 in order to swivel the receiving means 3 about the pivot axis 4, by means of retracting the piston rod 6*a* starting from the position in FIG. 1, as is shown in FIG. 2*a* in a pivoting position of approximately 45° in relation to the initial position in FIG. 1, and in FIG. 2*b* in a position pivoted by approximately 90°. In FIG. 2*b*, the hydraulic cylinder 6 partly extends in the bar 3.2, which is preferably formed as a hollow profile, as is indicated by a dot-dash line between the positions of a hinge 6.1 at the support means 2 and a hinge 6.2 at the vertical bar 3.2.

As can be seen from FIGS. 2*a* and 2*b*, the pivot axis 4 of the receiving means 3 at the support means 2 is expediently positioned higher than the position of hinge 6.1 of the cylinder 6, so that the 90°-pivoting position in FIG. 2*b* can be realised more easily, wherein the vertical bar 32 of FIG. 1 is in a horizontal position.

The lifting device according to FIGS. 1 and 2*a*, 2*b* can have an elevation height of up to approximately 1900 mm, by means of moving the hydraulic pistons 1 out of the cylinders.

Due to the eccentric arrangement of the receiving means 3 on the hydraulic pistons 1, transverse forces arise, and in order to allow better absorption of these arising transverse forces, preferably four hydraulic pistons 1 are provided, only two of which are visible in FIG. 1. However, it is also possible to have a single hydraulic piston 1, which can absorb the arising transverse forces due to the dimensioning of its diameter.

By means of this structure of the lifting device, a tilting position can be provided in all lifting positions of the lifting device, in order to carry out the corresponding operations on an automobile held by the receiving means 3 between the platform comprising the horizontal bar 3.1 and the clamping arm 3.3.

FIG. 3 shows a side view of an above-ground lifting device in the lowered position, in which the receiving means 3 for an automobile is formed substantially in the same way as the receiving means 3 of FIGS. 1 and 2*a*, 2*b*.

The above-ground lifting device is positioned on a basis B above the ground G (FIGS. 3*a* and 7) and has an elongated support means 20, which is fixed on the basis B in the form of a plate with one end, wherein the support means 20 is disposed in an inclined manner relative to the plate-like basis B. A lifting cylinder 11 is hingedly mounted between the free end of the support means 20 at 11.1 (FIG. 7) and at a hinge 11.2 on a guide arrangement in the shape of a parallelogram at 12, 15 in FIG. 7. This lifting cylinder 11 applies a force at the receiving means 3 via the hinge 11.2 on a guide bar 12.

In the embodiment shown the hinge 11.2 of the lifting cylinder 11 is provided on a nose 12*a* which is provided for example by welding on the underside of the guide bar 12.

The parallelogram is embodied by the hinges 12.1, 13, 15.1 and 15.2.

FIG. 7 shows the parallelogram arrangement between the guide bar 12 and a swivel cylinder 15 in the partly lifted position of the receiving means 3 above ground G. This parallel arrangement between elongated elements 12 and 15 is maintained as long as the receiving means 3 is only lifted and lowered by the lifting cylinder 11, which acts on the guide bar 12 at hinge 11.2.

FIG. 3*a* shows a lifting position of the above-ground lifting device, while FIG. 4 shows a tilting position of approximately 45° wherein the automobile is lifted only very slightly.

FIG. 6 shows an enlarged representation of the guide arrangement between support means 20 and receiving means 3 corresponding to the position in FIG. 4, while

Figure 6:
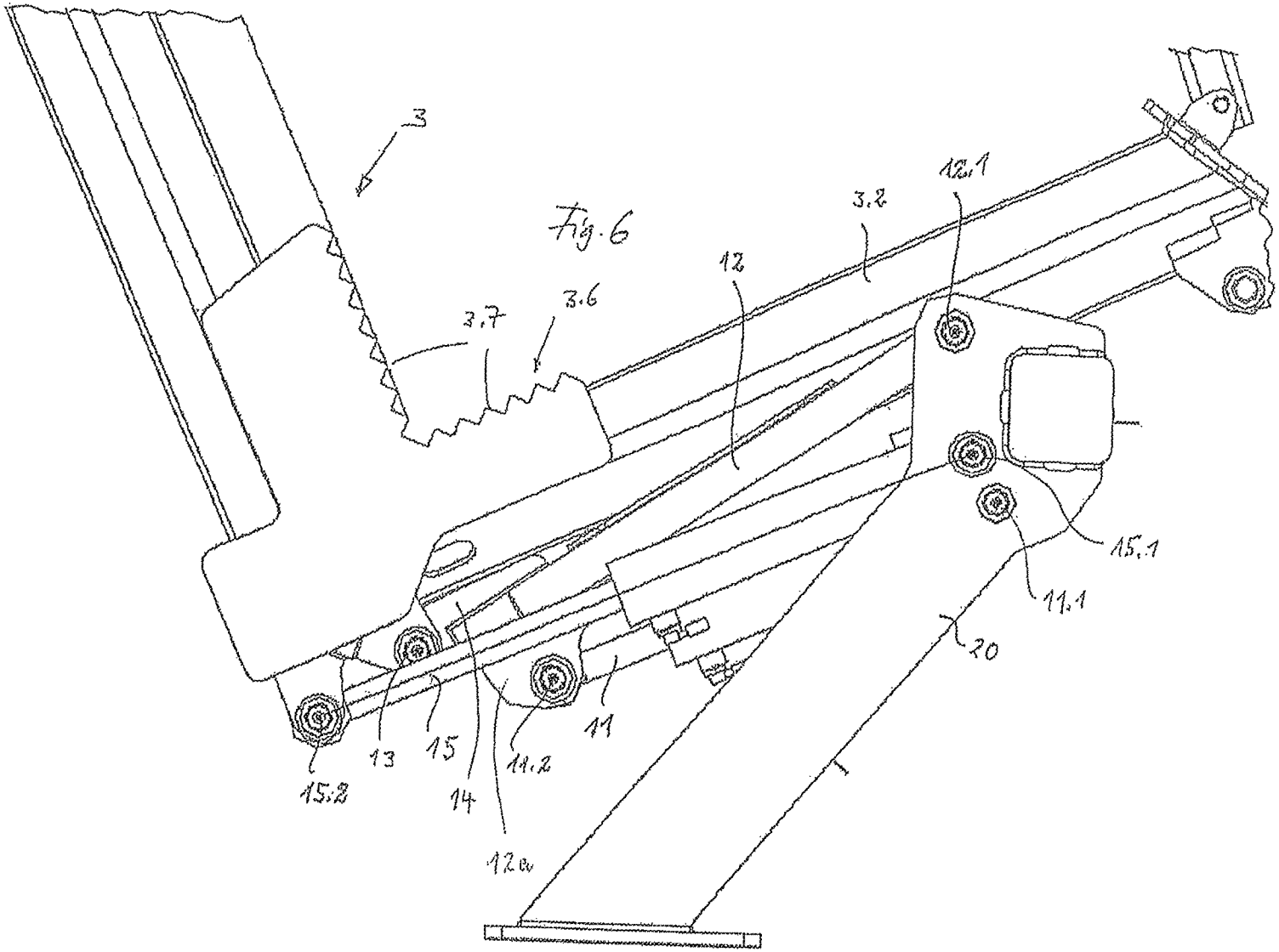
Figure 6A:
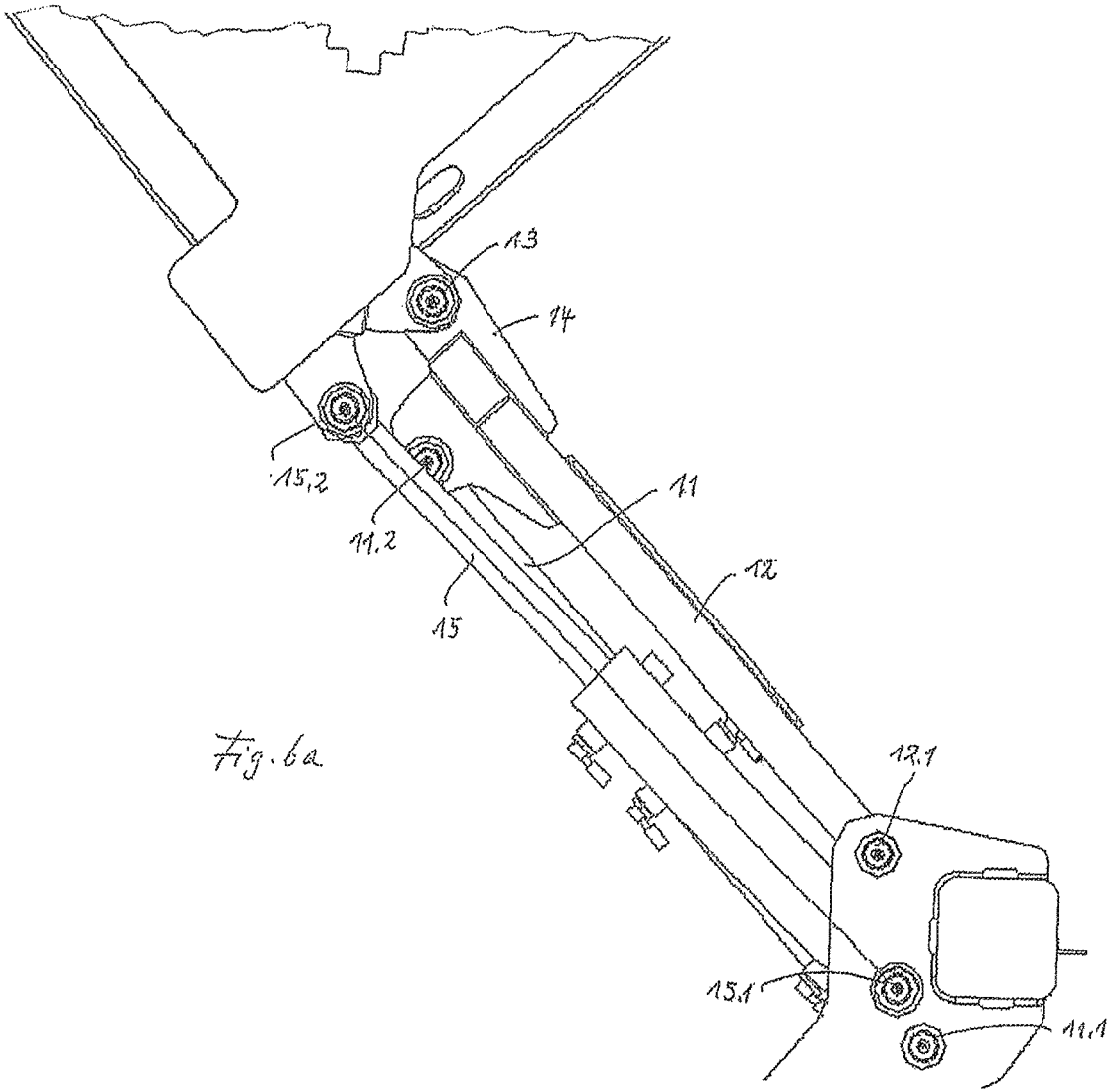
FIG. 6*a* presents an enlarged representation of the guide arrangement according to the position in FIG. 5.
Figure 7:
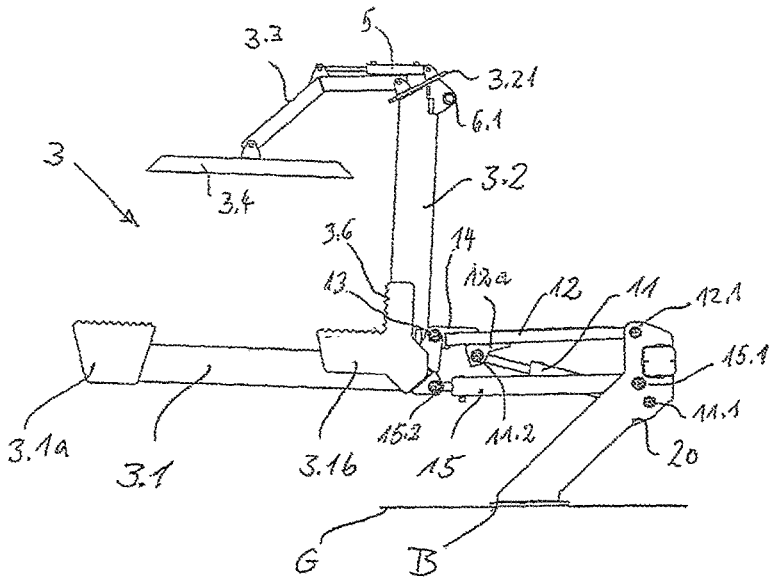

The receiving means 3 is guided by the guide arrangement in the shape of a parallelogram 12, 15 during the lifting movement and is lifted and lowered by means of the lifting cylinder 11, which is hingedly mounted at 11.1 near the free end of the support means 20 and at 11.2 at the end of a guide bar 12, which is connected to a bracket 14 which is hingedly mounted at the receiving means 3 at 13 (FIGS. 6*a* and 7). By way of example, the guide bar 12 is welded to the bracket 14. By moving out the piston of the lifting cylinder 11, the receiving means 3 is lifted and guided by the guide bar 12 actuated by the lifting cylinder 11.

According to the invention, a swivel cylinder 15 is provided which is hingedly mounted at 15.1 near the free end of the elongated support means 20, and by means of its piston rod at 15.2 at the receiving means 3. By moving out the piston of the swivel cylinder 15, the receiving means 3 is swiveled out of the horizontal position about the bearing or hinge 13 between the bracket 14 fixed to the guide bar 12 and receiving means 3. By retracting the piston rod into the swivel cylinder 15, the receiving means 3 is swiveled back into the horizontal position.

Figure 1:
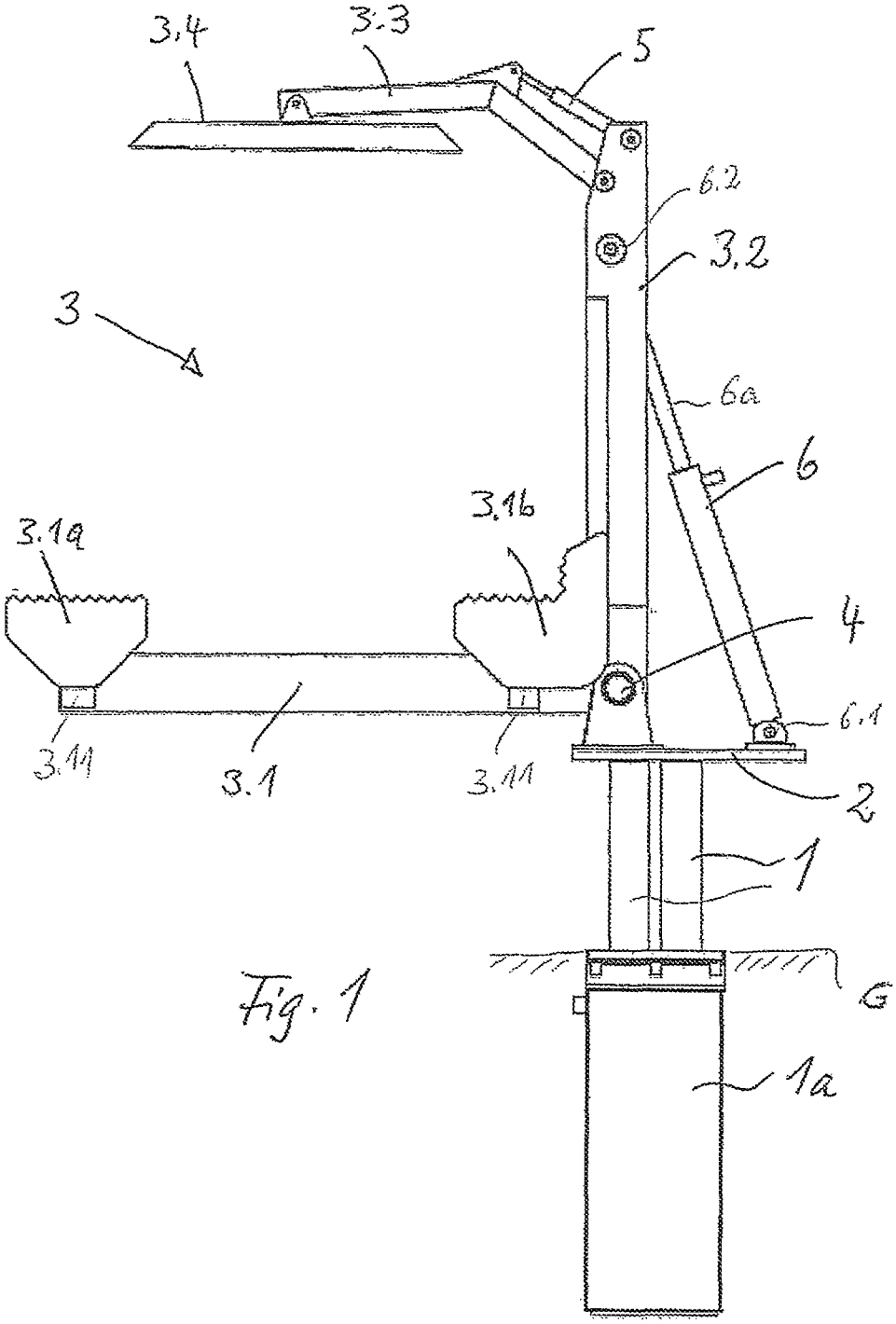
Figure 2A:
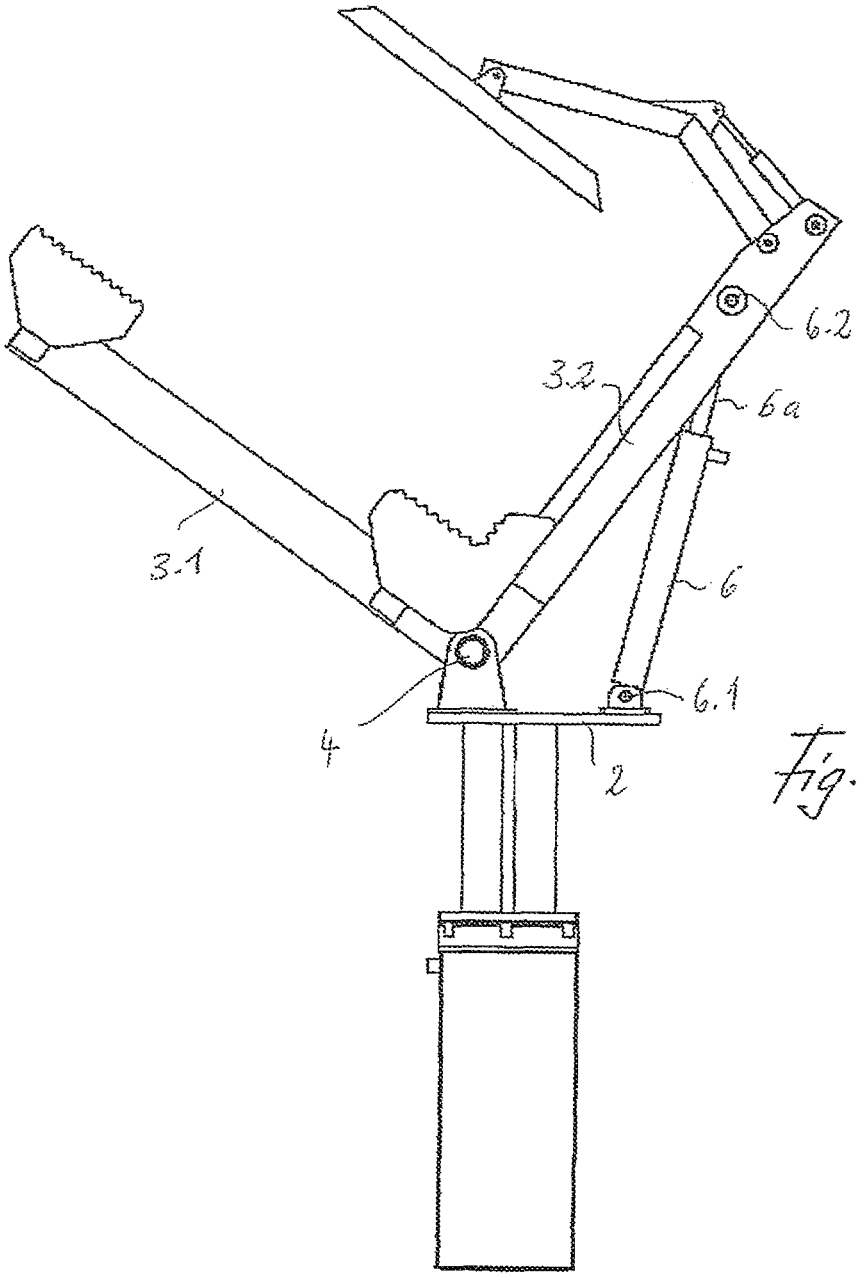
Figure 2B:
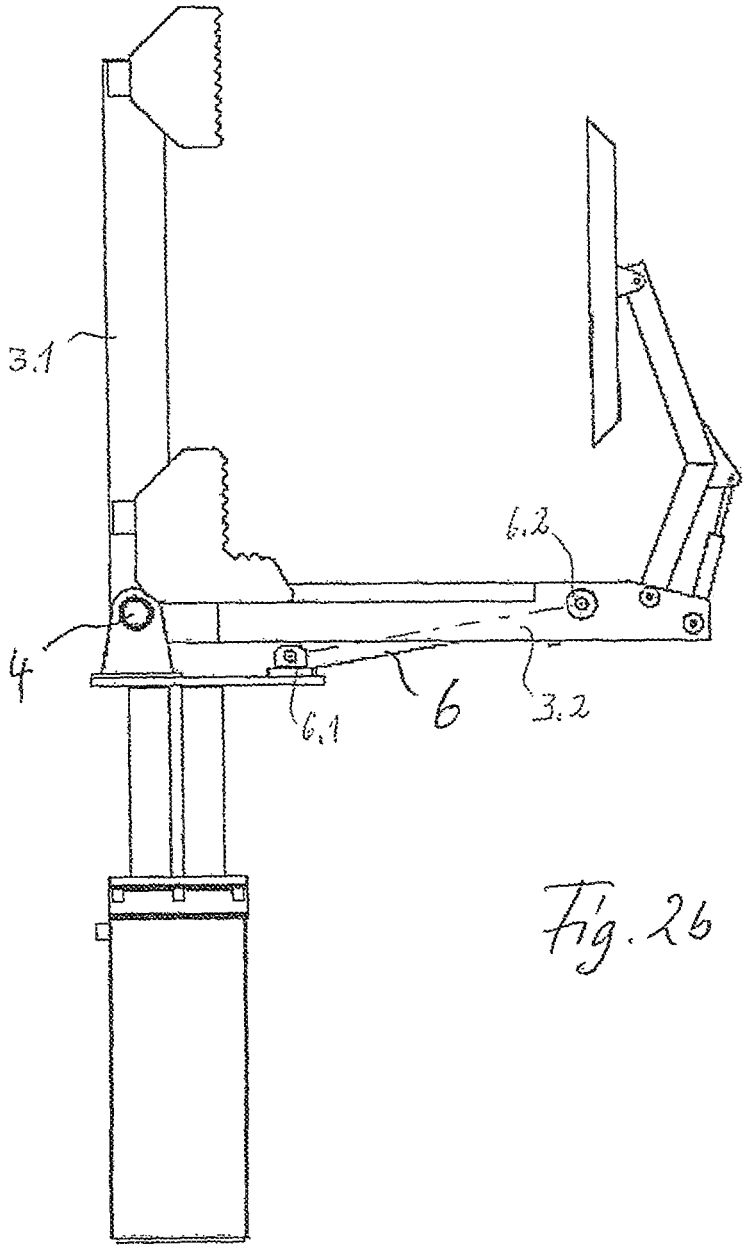
Figure 3:
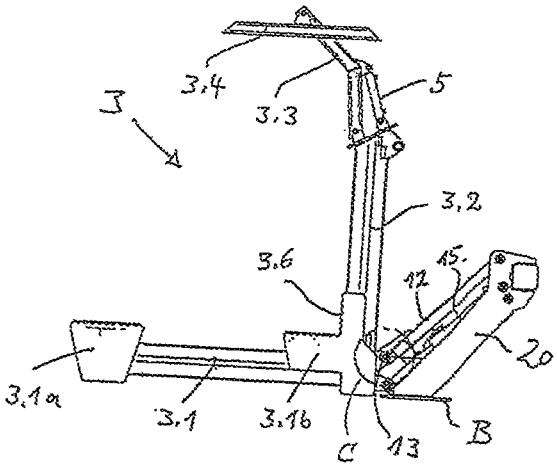
Figure 4:
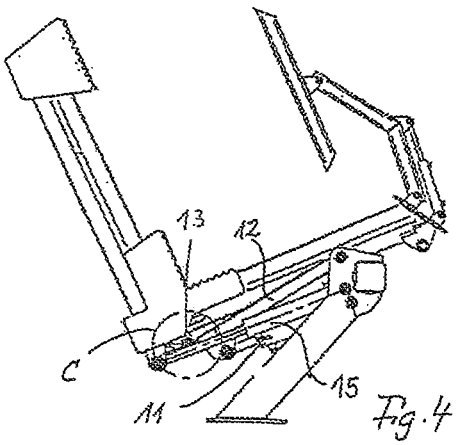
Figure 5:
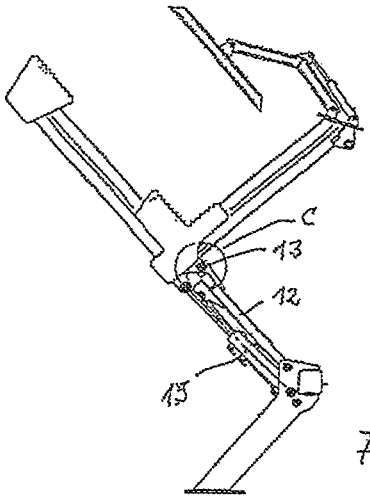
FIG. 5 shows a lifting position in connection with a tilting position of approximately 45°.

The bearing 13 has a pivot axis which corresponds to the pivot axis 4 in FIGS. 1 and 2. In FIGS. 3 to 5, a circle C is shown around the hinge 13 only to show that this is the central hinge for tilting the receiving means 3 in relation to the stationary support means 20.

The hinges 12.1 and 15.1 on the support means have a distance from each other essentially in the same way as the bearing or hinge 13 and hinge 15.2 on the receiving means 3. Hinge 11.2 fixed on the guide bar 12 has a distance from bearing or hinge 13, so that the lifting cylinder 11 can lift and lower the receiving means 3.

At the receiving means 3, a lateral stop 3.6 (FIGS. 7 and 6) for the automobile is provided laterally of the inside plates 3.1*b*, to hold the automobile in the receiving position.

Preferably, a corrugated or serrated structure 3.7 (FIG. 6) is provided at the lateral stop 3.6 and at the plates 3.1*a* and 3.1*b*, to better hold the received automobile.

Retaining claws can also be provided for fixing the automobile in the receiving position in the receiving means 3, for example a retaining claw (not shown) which is displaceable on the bar 3.1 and which presses the automobile against the lateral stop 3.6.

FIG. 7 is a side view of the above-ground lifting device in a partly lifted position, wherein the parallelogram arrangement of guide bar 12 and swivel cylinder 15 is clearly recognisable. In this position, the lifting cylinder 11 extends at an angle between the guide bar 12 and the swivel cylinder 15.

On the upper end of the vertical bar 3.2 a plate 3.21 is fixed, on which the clamping arm 3.3 and the piston 5 for actuating the clamping arm 3.3 are articulated.

Figure 8:
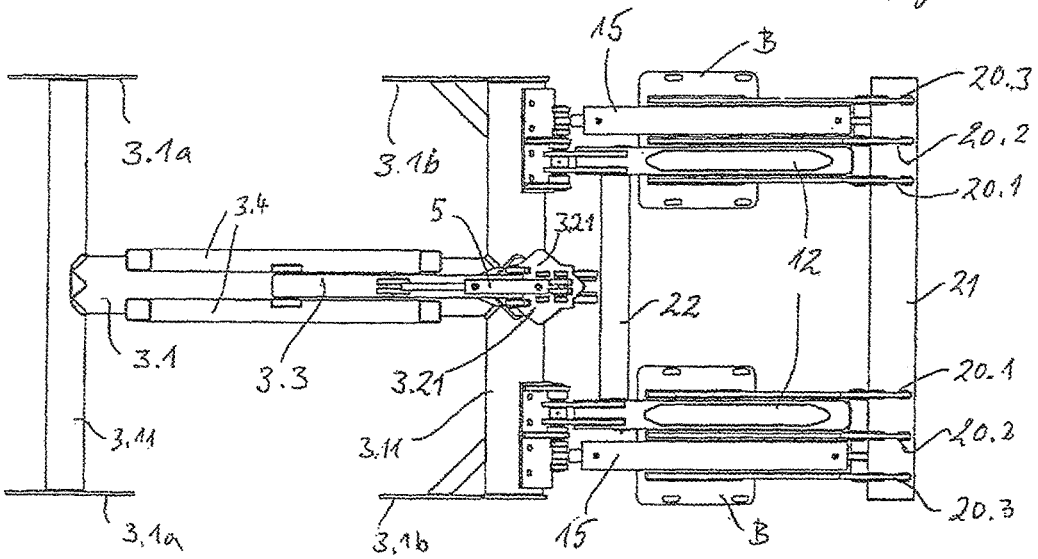

The clamping arm 3.3 has on the free end a clamping means in the form of two bar-like elements 3.4, as shown in FIG. 8. Also a plate can be provided as a clamping means 3.4.

On the other end of the vertical bar 3.2 in FIG. 7, a hinge 6.1 is provided, which has no function in the above-ground lifting device but is provided only for the purpose that the vertical bar 3.2 can also be used for an in-ground lifting device of FIG. 1, wherein the lifting cylinder 6 is hingedly connected with the vertical bar 3.2.

FIG. 8 is a plan view of the above-ground lifting device in FIG. 7, wherein it can be seen that the vertical bar 3.2 is arranged in the middle of the lifting device. Two elongated support means 20 are provided, each on a base plate B, wherein the support means 20 arranged at a distance from each other are connected to each other by a connecting bar 21. Further, the two guide bars 12 of the two guide arrangements are connected together by a connecting bar 22. The connecting bar 22 in FIG. 10 is preferably positioned in the area of shoulders 12.1 (FIG. 7) mounted on the guide bars 12; however, the connecting bar 22 can also connect the two parallel guide bars 12 directly with each other on another location, to achieve rigidity of the construction.

As the plan view in FIG. 8 shows, on each side the guide bars 12 and the swivel cylinders 15 are guided in a parallel manner beneath each other so that, in the position shown in FIG. 6, these component parts do not hinder each other when the guide arrangement is actuated by the lifting cylinder 11 and/or the swivel cylinder 15.

The lifting cylinder 11 is positioned in the plan view of FIG. 8 beneath the guide bar 12.

As shown in FIG. 8, the elongated support means 20 is embodied preferably by three parallel plates 20.1 to 20.3, so that the elements 11, 12 and 15 can be moved between these plates of the support means 20, as shown in FIG. 3 and FIG. 6.

Further, FIG. 8 shows that the two lifting and tilting mechanisms 11, 12, 15 are hingedly connected to the inner strut 3.11 of the receiving means 3. Such an arrangement is not necessary in an in-ground lifting device (FIG. 1) as the tilting or swivel cylinder 6 connected with the vertical bar 3.2 is hingedly connected with the movable support plate 2, on which also the receiving means 3 is hingedly positioned at the hinge 4.

Various modifications of the structure described are possible. For example, it is also possible for the approximately L-shaped receiving means 3, in which the clamping arm 3.3 positioned at the top is pivotable by the hydraulic cylinder 5, to be displaceable along the vertical bar 3.2.

Figure 3A:
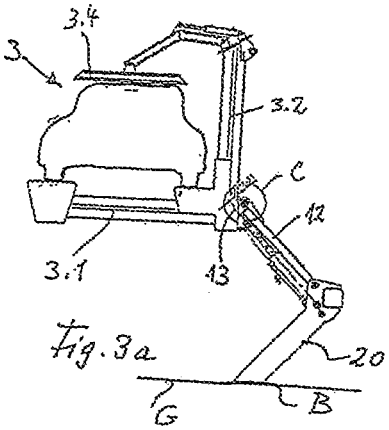

Further, the receiving means 3, which extends around the automobile on three sides in the embodiment shown (FIG. 3*a*), can also be formed as a rectangular frame which surrounds the automobile, wherein, by means of hydraulically operated clamping means, the automobile can be fixed and clamped in the frame in the vertical and/or in the lateral direction, so that it cannot move relative to the receiving means 3 during pivoting.

The hinged mounting of the receiving means 3 at the support means 2 and at the support means 20 is designed such that a pivoting position of the receiving means 3 by approximately 90° is also possible in the unlifted position of the lifting device.

Center bar 3.1 and struts 3.11, which are arranged in the form of H as shown in FIG. 8, provide a platform on which the automobile is positioned. Due to the fact that there are elongated elements like the center bar 3.1 and the struts 3.11, there is a maximum of free space for better working on the underside of the lifted automobile. This platform 3.1, 3.11 in the form of letter H can also be embodied in another way.

The invention claimed is:

1. A lifting device comprising a lifting device (1; 11, 12) and a receiving unit (3) for receiving a vehicle, said receiving unit (3) being mounted pivotally and tiltably on the lifting device (1; 11, 12), and at least one clamping device (3.3) is provided at the receiving unit (3) for fixing the vehicle on the receiving unit (3) characterized in that an elongate stationery support unit (20) is arranged in a slanted position on a horizontal base (B), a guide rod (12) is hinged between a free end of the support unit (20) and the receiving unit (3), and a tilt cylinder (15) is articulatedly hinged between the free end of the support unit (20) and the receiving unit (3) parallel to the guide rod (12), wherein the piston rod of the tilt cylinder tilts the receiving unit (3) relative to the stationary support unit (20), and wherein a lifting cylinder (11) is positioned between guide rod (12) and tilt cylinder (15) in a slanted arrangement.

2. The lifting device according to claim 1, wherein the receiving unit (3) surrounds at least three sides of the vehicle and on at least one side the clamping device (3.3) is provided for fixing the vehicle.

3. The lifting device according to claim 1, wherein the receiving unit (3) has a platform (3.1, 3.11), on which the vehicle is supported, and a vertical bar (3.2) arranged laterally at the platform (3.1, 3.11) at an angle of approximately 90° thereto, at which vertical bar a clamping arm of the clamping device (3.3) is mounted so as to be pivotable or displaceable by means of a hydraulic cylinder (5).

4. The lifting device according to claim 1, wherein the receiving unit (3) is tiltable around a pivot axis of hinge (13) through the tilt cylinder (15), which is hingedly mounted between receiving means (3) and the support unit (20).

5. The lifting device according to claim 1, wherein for forming an above-ground lifting device the support unit (20) is disposed stationary on the base (B) which is arranged above a ground (G).

6. The lifting device according to claim 1, wherein the receiving the unit (3) is tiltably around a pivot axis (13) disposed between the guide rod (12) and the receiving unit (3), wherein the tilt cylinder (15) is hingedly connected to the receiving unit (3) at a distance below the pivot axis (13).

7. The lifting device according to claim 5, wherein the support unit (20) is formed by parallel plates (20.1 to 20.3) which are arranged at a distance from each other, and wherein the lifting cylinder (11), the guide rod (12) and the tilt cylinder (15) are arranged between the plates (20.1 to 20.3).

8. The lifting device according to claim 3, wherein two support units (20) are arranged at a distance from each other and connected by connecting rods (21-22), wherein the platform (3.1, 3.11) is hingedly connected with the two lifting and tilting mechanisms of the two support units (20), and wherein the vertical bar (3.2) is positioned midway between the two lifting and tilting mechanisms.

9. The lifting device according to claim 3, wherein the platform for receiving the vehicle at the receiving units (3) is formed by elongate members between which there is a free working space for work on the vehicle.

10. The lifting device according to claim 9, wherein the platform is formed by a central support beam (3.1) and laterally projecting struts (3.11) at the two ends of the central support beam so that the platform has an H-shape in top view.

* * * * *